US006056650A

United States Patent [19]

Yamagishi et al.

[11] Patent Number: 6,056,650

[45] Date of Patent: May 2, 2000

[54] MULTI-PIECE SOLID GOLF BALL

[75] Inventors: Hisashi Yamagishi; Junji Hayashi; Hiroshi Higuchi, all of Chichibu, Japan

[73] Assignee: Bridgestone Sports Co., Ltd., Tokyo, Japan

[21] Appl. No.: 09/124,363

[22] Filed: Jul. 29, 1998

[30] Foreign Application Priority Data

Jul. 30, 1997 [JP] Japan ..... 9-219282

[51] Int. Cl.[7] ..... A63B 37/14

[52] U.S. Cl. ..... 473/384; 473/377; 473/379

[58] Field of Search ..... 473/384

[56] References Cited

U.S. PATENT DOCUMENTS 5,273,287 12/1993 Molitor et al. ..... 473/384

FOREIGN PATENT DOCUMENTS 2 300 574 11/1996 United Kingdom .

2 320 440 6/1998 United Kingdom .

2 323 540 9/1998 United Kingdom .

*Primary Examiner*—Jeanette Chapman

*Assistant Examiner*—Raeann Gorden

*Attorney, Agent, or Firm*—Sughrue, Mion, Zinn, Macpeak & Seas, PLLC

[57] ABSTRACT

In a multi-piece solid golf ball comprising a solid core and a cover with a multilayer construction including an innermost layer, an intermediate layer, and an outermost layer having a plurality of dimples on the surface thereof, the innermost and outermost layers each have a Shore D hardness of at least 60, and the intermediate layer has a Shore D hardness of at most 40. The total number of dimples is 370–450, and the dimples cover at least 65% of the golf ball surface. The ball gives a good, soft feel when hit with any type of club. The performance of the ball little depends on the head speed.

15 Claims, 1 Drawing Sheet

MULTI-PIECE SOLID GOLF BALL

BACKGROUND OF THE INVENTION

1. Field of the Invention

The present invention relates to a multi-piece solid golf ball with at least a four-layer construction. More particularly, it relates to a multi-piece solid golf ball which has a good, soft feel when hit with any type of club, ranging from a driver to a putter, and enables an increased flight distance to be achieved over a broad range in head speed (i.e., from low to high head speeds), and can thus provide good performance regardless of the head speed and the type of club used.

2. Prior Art

Golf balls having a variety of constructions are available today on the market. Of these, the golf balls generally used for competitive play are either two-piece solid golf balls having a rubber-based core enclosed within a cover made of ionomer resin or the like, or thread-wound golf balls comprising a solid or liquid center about which is wound a rubber thread which is in turn enclosed within a cover.

Most golfers of ordinary skill use two-piece solid golf balls because of their excellent flight performance and durability. However, these balls have a very hard feel when hit, in addition to which the rapid separation of the ball from the head of the club results in poor control. For this reason, many professional golfers and skilled amateurs prefer using thread-wound golf balls to two-piece solid golf balls. Yet, although thread-wound golf balls have a superior feel and controllability, their flight distance and durability fall short of those for two-piece solid golf balls.

Thus, two-piece solid golf balls and thread-wound golf balls today provide mutually opposing features, and so golfers select which type of ball to use based on their level of skill and personal preference.

This situation has prompted efforts to approximate the feel of a thread-wound golf ball in a solid golf ball. As a result, a number of soft, two-piece solid golf balls have been proposed. A soft core is used to obtain such soft two-piece solid golf balls, but making the core softer lowers the resilience of the golf ball, compromises flight performance, and also markedly reduces durability. As a result, not only do these balls lack the excellent flight performance and durability characteristic of ordinary two-piece solid golf balls, but they are often in fact unfit for actual use.

Various three-piece solid golf balls having a three-layer construction in which an intermediate layer is situated between a solid core and a cover have been proposed to resolve these problems. For example, JP-B 55077/1992 and JP-A 64-80377/1989 disclose golf balls in which the core is formed by enclosing a soft, relatively small inner layer (outside diameter, 24 to 29 mm; Shore D hardness, 15 to 30) within a hard outer layer (outside diameter, 36 to 41 mm; Shore D hardness, 55 to 65), so that the ball may exhibit both a long flight distance and a feel and control similar to that of a thread-wound ball. In another ball of this type, as described in JP-A 24084/1995,a soft intermediate layer is provided between the center core and the cover serving as the outermost layer of the ball in order to improve the feel without sacrificing the good flight performance and durability characteristic of solid golf balls.

However, the above-described three-piece solid golf balls are targeted primarily at golfers having a rapid head speed of at least 45 m/sec, and thus are necessarily suited to high-caliber players. When used by high head speed golfers, these balls are able to provide an increased flight distance and a good feel. Yet, when the same golf balls are used by low head speed golfers such as beginners, ladies,and seniors, the weakness of the force applied to the ball at the time of impact results in only a small amount of ball deformation and a greater dependence on the head speed to propel the ball. Thus an increased flight distance and a good feel are not obtained.

Moreover, with the rise in the golfing population, the attributes that golfers look for in a golf ball, such as flight performance, feel, control, and durability, have become more diverse and individualized. A need has been felt in the sport for the development of golf balls which are capable of accommodating differences in the ability and preferences of individual players, and which have, in particular, a low dependence on the head speed of the club.

SUMMARY OF THE INVENTION

An object of the present invention is to provide a highly-quality, high-performance multi-piece solid golf ball having an increased flight distance over a broad range in head speed, from low head speeds to high head speeds, and having also a good, soft feel when hit with any type of club, from a driver to a putter.

Regarding a multi-piece solid golf ball comprising a solid core and a cover enclosing the solid core, which cover has a multilayer construction including an innermost layer that encloses the solid core, at least one intermediate layer that encloses the innermost layer, and an outermost layer that encloses the intermediate layer and has a plurality of dimples on the surface thereof, have found that the cover and dimples can be optimized by adjusting the Shore D hardness values of the cover layers so that the intermediate layer has a Shore D hardness which is optimal and lower than the hardnesses of the innermost and outermost layers (that is, hard/soft/hard structure cover), and by specifying both the total number of dimples formed in the outermost layer and the proportion of the golf ball surface covered by dimples. By virtue of the synergistic effects of the above construction and selection, there can be obtained a multi-piece solid golf ball which has a good, Soft feel when struck with a driver yet is highly suitable also for putting, which optimizes the amount of spin on a driver shot, thereby avoiding excessive height in the flight path of the ball and maximizing the flight distance, and which allows increased flight distance to be achieved particularly at low head speeds. We have thus found that a high-quality, high-performance multi-piece solid golf ball of the type described above can be obtained which is able to minimize head speed dependence, which can considerably increase the flight distance over a broad range in head speed, from low to high head speeds, and which has a good, soft feel when hit with any type of club, ranging from a driver to a putter.

Accordingly, the present invention provides a multi-piece solid golf ball comprising a solid core and a cover enclosing the solid core, which cover has a multilayer construction including an innermost layer that encloses the solid core, at least one intermediate layer that encloses the innermost layer, and an outermost layer that encloses the intermediate layer and has a plurality of dimples on the surface thereof, wherein the innermost layer has a Shore D hardness of at least 60, the intermediate layer has a Shore D hardness of at most 40, and the outermost layer has a Shore D hardness of at least 60, the outermost layer has a total number of dimples ranging from 370 to 450, and the dimples cover at least 65% of the golf ball surface.

In one preferred embodiment of the invention, the difference in hardness between the innermost layer and the outermost layer is not more than 3 Shore D units; and the difference in hardness between the outermost layer and the intermediate layer and/or the difference in hardness between the innermost layer and the intermediate layer is preferably at least 20 Shore D units. The dimples are preferably of at least two types having different diameters. The diameter of the largest diameter dimples is from 3.8 to 4.3 mm and the diameter of the second largest diameter dimples is from 3.3 to 4 mm. In a further preferred embodiment of the invention, the outermost layer is composed primarily of an ionomer resin, the intermediate layer is composed primarily of a thermoplastic polyester elastomer, and the innermost layer is composed primarily of an ionomer resin.

The objects, features and advantages of the invention will become more apparent from the following detailed description.

BRIEF DESCRIPTION OF THE DRAWINGS

The sole FIGURE.

DETAILED DESCRIPTION OF THE INVENTION

Figure 1:
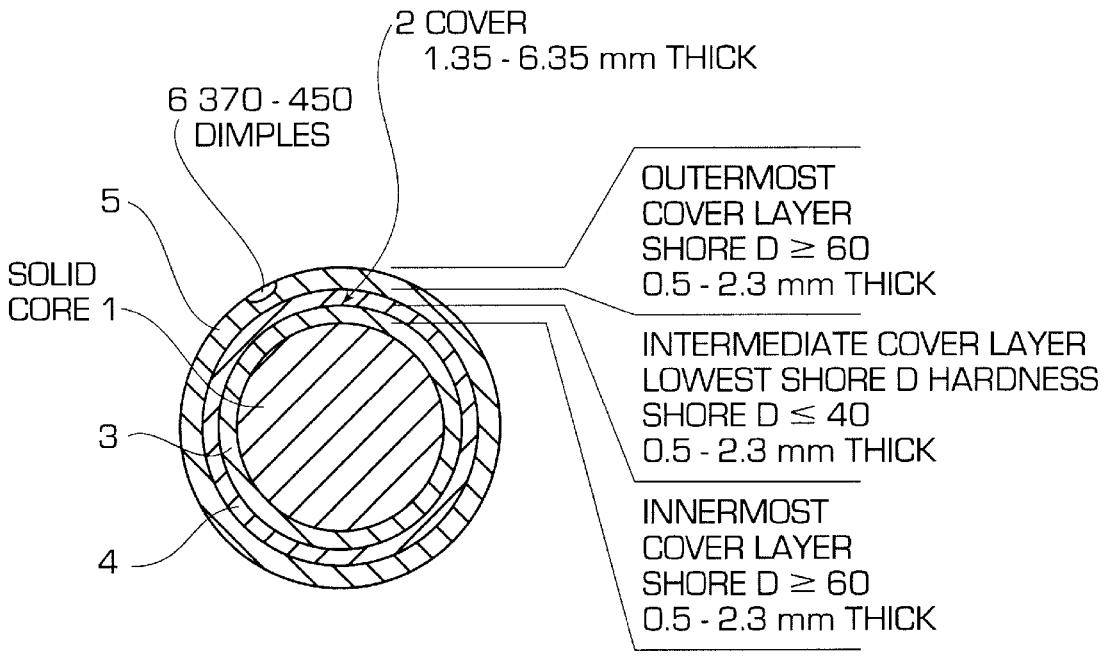
FIG. 1 is a cross-sectional view of a golf ball according to one embodiment of the invention.

Referring to FIG. 1, the multi-piece solid golf ball according to the present invention is comprised of a solid core 1 and a cover 2 enclosing the core 1. The cover 2 has a multilayer construction including an innermost layer 3, an intermediate layer 4, and an outermost layer 5 which enclose the solid core 1 in that order.

As with the solid core of a conventional two-piece solid golf ball, the solid core 1 of the multi-piece solid golf ball according to this invention is made of a base rubber composed primarily of cis-1,4-polybutadiene. After compounding the base rubber with known additives such as crosslinking agents, co-crosslinking agents and inert fillers, the solid core may be molded by a method known to the art.

The diameter of the solid core 1 is preferably from 30to 40 mm, and more preferably from 32.5 to 39.5 mm. The hardness of the core, expressed as the amount of deflection under a load of 100 kg, is preferably from 2 to 7 mm, and more preferably from 2.5 to 6 mm. A core with a deflection of less than 2 mm is too hard for the ball to have a good feel when hit, whereas a deflection of more than 7 mm results in too soft a core, making it impossible to achieve an excellent flight performance. The core may have a single-layer or a multilayer construction.

The multi-piece solid golf ball of the present invention is formed by enclosing the above-described solid core 1 with the cover 2. As already noted, the cover 2 is formed with a three-layer construction including the innermost layer 3 that encloses the solid core 1, the intermediate layer 4 that encloses the innermost layer 3, and the outermost layer 5 that encloses the intermediate layer 4.

The cover of the golf ball in this invention is provided with hardness characteristics such that, in the above-described three-layer construction, the intermediate layer 4 has the lowest Shore D hardness, with the innermost layer 3 and the outermost layer 5 both being harder than the intermediate layer 4. "Shore D hardness," as used herein, refers to the hardness measured by a method in accordance with ASTM 2240.

It is recommended that the Shore D hardness of the intermediate layer 4 in the present invention be up to 40,preferably up to 38, and more preferably up to 35. When the Shore D hardness is greater than 40, the ball feels hard when hit with a putter or on an approach shot. The lower limit in hardness is preferably a Shore D hardness of not less than 20, and more preferably not less than 25.

It is critical that the Shore D hardnesses of both the innermost layer 3 and the outermost layer 5 in the present invention be at least 60. More specifically, the Shore D hardness of the innermost layer 3 must be at least 60,preferably at least 63, and more preferably at least 65.Similarly, the Shore D hardness of the outermost layer 5 must be at least 60, preferably at least 63, and more preferably at least 65. The upper limit in the hardness for these two layers is preferably a Shore D hardness of not more than 75, and more preferably not more than 70.

As noted above, the innermost layer 3 and the outermost layer 5 are both harder than the intermediate layer 4. Moreover, the difference in hardness between the innermost layer 3 and the outermost layer 5 is preferably not more than 3 Shore D units, and more preferably not more than 2 Shore D units. Accordingly, it is advantageous for the hardness of the innermost layer 3 and the outermost layer 5 to be the same or closely similar values. If there is to be a difference in hardness between the innermost layer 3 and the outermost layer 5, it is preferable for the innermost layer 3 to be given a Shore D hardness higher than that of the outermost layer 5.

In practicing the present invention, it is also recommended that one and preferably both of the differences in hardness between the innermost layer 3 and outermost layer 5 having the above-specified hardnesses and the intermediate layer 4 be preferably at least 20, more preferably at least 22, and most preferably at least 25.These differences in hardness are preferably up to 45 Shore D units, and more preferably up to 40 shore D units.

The innermost layer 3, intermediate layer 4, and outermost layer 5 constructing the cover 2 of this invention may each be formed of any known cover stock so long as the above-specified hardnesses are satisfied. Preferably, the innermost layer 3 and the outermost layer 5 are composed primarily of ionomer resins, and the intermediate layer 4 is composed primarily of a thermoplastic polyester elastomer.

Known ionomer resins may be used to form the above-described innermost layer 3 and outermost layer 5. Some exemplary ionomer resins are Himilan 1557, Himilan 1601, Himilan 1605, Himilan 1706, Himilan AM7317, and Himilan AM7318, all manufactured by DuPont-Mitsui Polychemicals Co., Ltd. These may be used singly or as mixtures of two or more thereof.

Preferable examples of thermoplastic polyester elastomers which can be used to form the intermediate layer 4 include commercially available thermoplastic polyester elastomers such as Hytrel 4047, Hytrel 4767, and Hytrel 5557, all from DuPont-Toray Co., Ltd. Intermediate layer 4 may itself be composed of two or more layers, which may be formed using the materials just mentioned.

In addition to the foregoing resin components, various additives, such as pigments, dispersants, antioxidants, ultraviolet absorbers, and parting agents, may be added in conventional amounts to the respective cover stocks if necessary.

The overall thickness of the cover 2 formed of the above-described materials is preferably from 1.35 to 6.35 mm, and more preferably from 1.5 to 6.0 mm. The thicknesses of the innermost layer 3, intermediate layer 4, and outermost layer 5 constructing the cover 2 are suitably adjusted in accordance with the above-mentioned cover thickness. Although no particular limits are imposed on the thicknesses of the respective layers in this case, the innermost layer 3 preferably has a thickness of 0.5 to 2.3mm, and especially 1.0 to 2.0 mm; the intermediate layer 4 preferably has a thickness of 0.5 to 2.3 mm, and especially 1.0 to 2.0 mm; and the outermost layer 5 preferably has a thickness of 0.5 to 2.3 mm, and especially 1.0 to 2.0 mm.

Any suitable method may be employed to enclose the solid core 1 within the innermost layer 3, the intermediate layer 4, and the outermost layer 5. For example, these three layers may be formed about the solid core 1 by surrounding the core with a pair of hemispherical half-cups preformed from the three-layer construction and molding under applied heat and pressure, or by successively injection-molding the cover compositions around the solid core 1.

The golf balls of this invention have a plurality of dimples 6 formed in the outermost layer 5. The total number of dimples is from 370 to 450, and preferably from 380 to 440. The dimples cover at least 65%, and preferably from 68 to 85%, of the golf ball surface (this factor being designated as dimple surface coverage as defined below). The total number of dimples mentioned above is the number of dimples required to assure a dimple surface coverage of at least 65%. The dimple surface coverage plays a role in the flight distance performance of the ball. A sufficient flight distance cannot be achieved when the dimple surface coverage is less than 65%. Provided that the golf ball is a perfect sphere having an imaginary spherical surface, the "dimple surface coverage" is the ratio of the total surface area of the imaginary sphere delimited by the edges of the individual dimples to the entire surface area of the imaginary sphere.

In the present invention, the dimples 6 may all be of the same shape or may be of two or more types having different diameters, so long as the above-specified total number of dimples and dimple surface coverage are satisfied. However, when working this invention, it is recommended that there be at least two types of dimples 6 having differing diameters, preferably two to six types, and more preferably two to four types. The diameter of the largest diameter dimples is preferably 3.8 to 4.3 mm, and especially 3.8 to 4.2 mm, and the diameter of the second largest diameter dimples is preferably 3.3 to 4 mm, and especially 3.3 to 3.9 mm. If the golf ball has dimples 6 of even smaller diameter in its surface, the diameter of these smaller dimples may be adjusted as appropriate.

Following formation of the dimples, golf balls having the essential features described above may then be subjected to finishing operations, such as surface buffing, painting, and stamping.

As already noted, the multi-piece solid golf balls of the present invention have a good, soft feel when hit with any type of club, whether it be a driver or a putter. Moreover, they have a very low head speed dependence, ensuring a good flight distance and feel to golfers of all head speeds, including not only moderate and high head speed players, but even low head speed players, and especially those with a head speed of about 35 m/s.

Other characteristics of the multi-piece solid golf balls of the present invention may be selected as appropriate under the Rules of Golf. For example, the diameter is not less than 42.67 mm, and the weight is not greater than 45.93 g.

EXAMPLES

Examples of the invention are given below by way of illustration, and are not intended to limit the invention.

Examples 1–3 and Comparative Examples 1–2

Solid cores having the diameters and hardnesses shown in Table 5 were prepared by kneading the solid core rubber compositions shown in Table 1 in a roll mill, then molding and vulcanizing at 155° C. for 15 minutes in a mold.

Next, the innermost layer, intermediate layer, and outermost layer materials formulated as shown in Tables 2and 3 were injection molded over the resulting solid cores. This was done in accordance with the selection shown in Table 5. Simultaneous with injection molding, dimples as specified in Table 4 were formed in the surface of the outermost layer. Four-piece solid golf balls were obtained in this way.

The solid core hardness, flight performance, and feel when hit of each of the resulting golf balls were evaluated by the methods described below. The results are shown in Table 6.

Hardness of Solid Core

This was expressed as the amount of deformation (mm) when a load of 100 kg was applied to the solid core.

Flight Performance

The golf balls were measured for carry and total distance when hit with a driver (number one wood) at head speeds of 45 m/s (HS45) and 35 m/s (HS35) using a swing robot.

Feel

The balls were hit with a driver (number one wood) at a head speed of about 45 m/s by three professional golfers and at a head speed of about 35 m/s by three top amateur women golfers. The feel of the balls upon impact was rated by the golfers according to the following criteria. The feel of the balls when hit with a putter was also similarly rated.

VS: Very soft

S: Soft

RH: Rather hard

H: Hard

TABLE 1

| Core composition | Examples | | | Comp. Ex. | |
|---|---|---|---|---|---|
| (parts by weight) | 1 | 2 | 3 | 1 | 2 |
| 1,4-Polybutadiene (cis structure) | 100 | 100 | 100 | 100 | 100 |
| Zinc acrylate | 22.3 | 24.2 | 18.4 | 24.2 | 24.2 |
| Dicumyl peroxide | 0.9 | 0.9 | 0.9 | 0.9 | 0.9 |
| Antioxidant | 0.2 | 0.2 | 0.2 | 0.2 | 0.2 |
| Zinc oxide | 5 | 5 | 5 | 5 | 5 |
| Barium sulfate | 41.4 | 40.8 | 42.8 | 42.8 | 10.9 |

TABLE 2

| Thermoplastic material (parts by weight) | A | B | C | D | E | F |
|---|---|---|---|---|---|---|
| Himilan AM7317 | 50 | | | | | see |
| Himilan AM7318 | 50 | | | | | Table |
| Himilan 1605 | | 50 | | | | 3 |
| Himilan 1706 | | 50 | | | | |
| Himilan 1601 | | | 50 | | | |
| Himilan 1557 | | | 50 | | | |

TABLE 2-continued

| Thermoplastic material (parts by weight) | A | B | C | D | E | F |
|---|---|---|---|---|---|---|
| Hytrel 5557 | | | | 100 | | |
| Hytrel 3078 | | | | | 100 | |

TABLE 3

| Rubber material (parts by weight) | F |
|---|---|
| 1,4-Polybutadiene (cis structure) | 100 |
| Zinc acrylate | 29 |
| Dicumyl peroxide | 0.9 |
| Antioxidant | 0.2 |
| Zinc oxide | 5 |
| Barium sulfate | 23 |

TABLE 4

| Dimple type | Diameter (mm) | Depth (mm) | Total number of dimples | Surface coverage (%) |
|---|---|---|---|---|
| I | 4.10 | 0.170 | 420 | 79.6 |
| | 3.70 | 0.150 | | |
| | 2.55 | 0.110 | | |
| II | 3.85 | 0.160 | 432 | 75.9 |
| | 3.30 | 0.135 | | |
| | 2.58 | 0.100 | | |
| III | 4.05 | 0.175 | 392 | 74.8 |
| | 3.85 | 0.165 | | |
| | 3.30 | 0.135 | | |
| IV | 3.30 | 0.200 | 500 | 64.8 |
| | 2.40 | 0.200 | | |

TABLE 5

| | | Examples | | | Comp. Ex. | |
|---|---|---|---|---|---|---|
| | | 1 | 2 | 3 | 1 | 2 |
| Solid core | Diameter (mm) | 32.6 | 32.6 | 32.6 | 32.6 | 28 |
| | Hardness (mm) | 5.0 | 4.5 | 6.0 | 4.5 | 4.5 |
| Innermost layer | Type of material | A | A | A | A | F |
| | Hardness of material (Shore D) | 68 | 68 | 68 | 68 | 50 |
| | Thickness (mm) | 1.5 | 1.5 | 1.5 | 1.5 | 3.1 |
| Intermediate layer | Type of material | E | E | E | E | D |
| | Hardness of material (Shore D) | 30 | 30 | 30 | 30 | 55 |
| | Thickness (mm) | 1.5 | 1.5 | 1.5 | 1.5 | 2.3 |
| Outermost layer | Type of material | B | B | A | B | C |
| | Hardness of material (Shore D) | 65 | 65 | 68 | 65 | 62 |
| | Thickness (mm) | 2.05 | 2.05 | 2.05 | 2.05 | 2.0 |
| Dimple type | | I | II | III | IV | IV |

TABLE 6

| | | Examples | | | Comp. Ex. | |
|---|---|---|---|---|---|---|
| | | 1 | 2 | 3 | 1 | 2 |
| HS45 | Carry (m) | 205.0 | 204.5 | 204.0 | 202.0 | 203.0 |
| | Total distance (m) | 220.0 | 221.0 | 219.0 | 216.0 | 215.5 |
| HS35 | Carry (m) | 157.0 | 157.0 | 158.0 | 155.0 | 155.5 |
| | Total distance (m) | 168.0 | 166.5 | 170.0 | 163.0 | 164.0 |

TABLE 6-continued

| | | Examples | | | Comp. Ex. | |
|---|---|---|---|---|---|---|
| | | 1 | 2 | 3 | 1 | 2 |
| Feel when hit | Three professional golfers | VS | S | VS | S | S |
| | Three amateur golfers | VS | S | VS | S | S |

As is apparent from the results in Table 6, the multi-piece solid golf balls having a four-layer construction of the present invention were found to have an increased flight distance at both a high head speed (HS45) and a low head speed (HS35), as well as a very good, soft feel when hit, regardless of whether a driver or a putter was used.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A multi-piece solid golf ball comprising; a solid core and a cover enclosing the solid core, said cover having a multilayer construction including an innermost layer that encloses the solid core, at least one intermediate layer that encloses the innermost layer, and an outermost layer that encloses the intermediate layer and has a plurality of dimples on the surface thereof, wherein, the innermost layer has a Shore D hardness of at least 60, the intermediate layer has a Shore D hardness of at most 40, and the outermost layer has a Shore D hardness of at least 60, the outermost layer has a total number of dimples in the range of 370 to 450, the difference in hardness between the innermost layer and the outermost layer is not more than 3 Shore D units, and the dimples cover at least 65% of the golf ball surface.

2. The multi-piece solid golf ball of claim 1, wherein one or both of the difference in hardness between the outermost layer and the intermediate layer and the difference in hardness between the innermost layer and the intermediate layer is at least 20 Shore D units.

3. The multi-piece solid golf ball of claim 1, wherein the dimples are of at least two different diameters, with the diameter of the largest diameter dimples being from 3.8 to 4.3 mm and the diameter of the second largest diameter dimples being from 3.3 to 4 mm.

4. The multi-piece solid golf ball of claim 1, wherein the outermost layer is composed primarily of an ionomer resin.

5. The multi-piece solid golf ball of claim 1, wherein the intermediate layer is composed primarily of a thermoplastic polyester elastomer.

6. The multi-piece solid golf ball of claim 1, wherein the innermost layer is composed primarily of an ionomer resin.

7. The multi-piece solid golf ball of claim 1, wherein the dimples are of at least two types having different diameters, with the diameter of the largest diameter dimples in the range of 3.8 to 4.2 mm and the diameter of the second largest diameter dimples in the range of 3.3 to 3.9 mm.

8. The multi-piece solid golf ball of claim 1, wherein said dimples comprise 380 to 440 dimples covering 68 to 85% of the golf ball surface.

9. The multi-piece solid golf ball of claim 1, wherein said dimples comprises at least two different diameters in the range of 3.8 to 4.2 mm for the largest diameter and 3.3 to 3.9 mm for the smaller diameter dimples.

10. The multi-piece solid golf ball of claim 1, wherein said innermost layer, said intermediate layer and said outermost layer each have a thickness in the range of 0.5 to 2.3 mm.

11. The multi-piece solid golf ball of claim 10, wherein said innermost layer has a thickness in the range of 1.0 to 2.0 mm.

12. The multi-piece solid golf ball of claim 10, wherein said intermediate layer has a thickness in the range of 1.0 to 2.0 mm.

13. The multi-piece solid golf ball of claim 1, wherein said cover has a thickness in the range of 1.35 to 6.35 mm.

14. The multi-piece solid golfball of claim 1, wherein the difference in hardness between said innermost layer and said outermost layer is not more than 2 Shore D units.

15. The multi-piece solid golf ball of claim 1, wherein said innermost layer has a Shore D hardness of at least 65.

* * * * *